US005890532A

United States Patent [19]

Kim et al.

[11] Patent Number: 5,890,532

[45] Date of Patent: Apr. 6, 1999

[54] HEAT EXCHANGER FOR AIR CONDITIONER

[75] Inventors: Young-Saeng Kim, Inchun; Youn Baek, Suwon, both of Rep. of Korea

[73] Assignee: Samsung Electronics Co., Ltd, Suwon, Rep. of Korea

[21] Appl. No.: 879,086

[22] Filed: Jun. 19, 1997

[30] Foreign Application Priority Data

Sep. 7, 1996 [KR] Rep. of Korea ..... 1996 27643

[51] Int. Cl.[6] ..... F28F 1/30

[52] U.S. Cl. ..... 165/151; 165/DIG. 503; 165/DIG. 504

[58] Field of Search ..... 165/151, DIG. 501–DIG. 504, 165/182

[56] References Cited

U.S. PATENT DOCUMENTS

| | | | |
|---|---|---|---|
| 5,111,876 | 5/1992 | Nash | 165/151 |
| 5,660,230 | 8/1997 | Obosu et al. | 165/151 |

FOREIGN PATENT DOCUMENTS

| | | | |
|---|---|---|---|
| 55-155193 | 12/1980 | Japan | 165/151 |
| 58-158495 | 9/1983 | Japan | 165/151 |
| 2-309195 | 12/1990 | Japan | 165/151 |
| 69304 | 8/1951 | Netherlands | 165/151 |
| 635188 | 4/1950 | United Kingdom | 165/151 |

*Primary Examiner*—Allen Flanigan
*Attorney, Agent, or Firm*—Burns, Doane, Swecker & Mathis, L.L.P.

[57] ABSTRACT

A heat exchanger for an air conditioner comprises parallel flat fins for conducting air flows therebetween, and parallel tubes passing perpendicularly through the flat fins for conducting heat exchanging fluid. Each fin includes vertical beads disposed above, below, in front of and behind the tubes for draining condensed water.

1 Claim, 4 Drawing Sheets

HEAT EXCHANGER FOR AIR CONDITIONER

BACKGROUND OF THE INVENTION

1. Field of the Invention

The invention relates to a heat exchanger for an air conditioner, and more particularly to a heat exchanger having a plurality of louver patterns above and below heat exchanging tubes perpendicularly passing through flat fins whereby the air currents flowing therethrough become turbulent and mixed and further a dead air region around each tube is reduced.

2. Description of the Prior Art

A conventional heat exchanger for an air conditioner includes, as shown in FIG. 1, a plurality of flat fins 1 arranged in a parallel relation to each other at predetermined intervals and a plurality of heat exchanging tubes 2 passing through the fins 1 perpendicular thereto. The air currents flow in the space defined between the fins 1 in the direction of the arrow in FIG. 1 and exchange heat with the fluid flowing in the heat exchanging tubes 2.

For a thermal fluid flowing around each flat fin 1, it has been known that the thickness of the thermal boundary layer 3 on both heat transfer surfaces of the fin 1 is gradually thickened in proportion to square root of the distance from the air current inlet end of the fin 1 as shown in FIG. 2. In this regard, the heat transfer rate of the fin 1 is remarkably reduced in proportion to the distance from the air current inlet end. Therefore, the above heat exchanger has a lower heat transfer efficiency.

For the thermal fluid flowing about each heat transfer pipe 102, it has been also known that, when lower velocity air currents flow in the direction of the arrow of FIG. 3, the air currents separate from the outer surface of the pipe 2 at portions spaced apart from the center point of outer surface of the pipe 4 at angles of 70-degree to 80-degree. Therefore, a dead air region 4 is formed behind each tube 2 in a direction of the air flow as shown in the hatched region of FIG. 3. In the dead air region 4, the heat transfer rate of the tube 2 is remarkably reduced so that the heat transfer efficiency of the above heat exchanger becomes worse.

In order to overcome the above problems, there has been proposed another solution as illustrated in FIGS. 4 and 5. This heat exchanger includes a plurality of heat exchanging tubes 2 which are fitted into the regularly spaced flat fins 1 such that the tubes 2 are perpendicular to the fins 1. The heat exchanger also includes a plurality of rectangular louver patterns P which are formed adjacent the tubes 2 passing through each fin 1, without any fin portions disposed between the tubes 2. Each louver 5*a*, 5*b*, 5*c*, 5*d*, or 5*e* is formed by bending at a given angle the louver's outer edges relative to the plane of the flat fin 1, respectively, by way of the cutting process. Also, the louvers are vertically positioned to the heat exchanging tubes 2.

The above-described louvers 5*a*, 5*b*, 5*c*, 5*d* and 5*e* make the air flow turbulent. This operation advantageously reduces the thickness of the thermal boundary layers formed on the fins 1. However, since upper and lower ends of each pattern of louvers are parallel to a tangent of the outer circumferential surface of the tube 2 and the patterns of louvers are generally rectangular, a dead air region still exists behind each tube 2 in a direction of the air flow. Also, there is a problem in that unmixed air currents flow in the spaces between the plurality of flat fins 1, and the expected improvement of the heat transfer effect due to mixing of air currents cannot be guaranteed.

Further, there is a problem in that said upper and lower edges of said louvers 5*a* to 5*e* are arranged in parallel relation to the air current flow S, resulting in an increased pressure drop that reduces the heat transfer performance.

SUMMARY OF THE INVENTION

Therefore, it is an object of the present invention to provide a heat exchanger which provides an improved heat transfer performance due to the turbulence and mixture of the air currents that flow in spaces between a plurality of flat fins, and also effectively reduces an air dead region found behind each tube in a direction of the air flow and thus improves the heat transfer performance.

Another object of the present invention is to provide the heat exchanger that provides (a) a draining function of condensed water generated on the heat exchanging tubes, (b) an enlargement of a whole surface area of the flat fins, and (c) an improved strength of the flat fins.

A heat exchanger for accomplishing the above objects is characterized in that vertical beads are formed on the flat fins and are situated above, below, in front of, and behind the heat exchanging tubes to provide (a) a draining function for condensed water generated on the heat exchanging tubes, (b) an enlargement of whole surface area of the flat fins, and (c) a reinforcement of the flat fins.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

The preferred embodiment according to the present invention will now be described in detail in accordance with the accompanying drawings. The same or corresponding elements or parts are designated with like references throughout the drawings.

Figure 1:
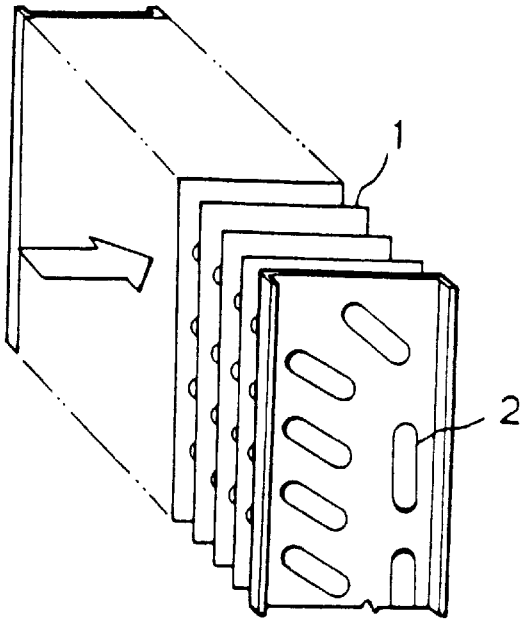
FIG. 1 (PRIOR ART)
FIG. 1 is a perspective view illustrating a conventional heat exchanger for an air conditioner.
Figure 2:
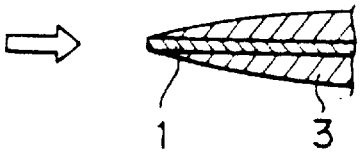
FIG. 2 (PRIOR ART)
FIG. 2 is an enlarged sectional view of a flat fin of the heat exchanger of FIG. 1, showing the characteristics of the thermal fluid flowing about the fin.
Figure 3:
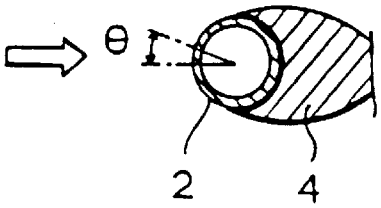
FIG. 3 (PRIOR ART)
FIG. 3 is an enlarged sectional view of a the heat exchanging tube of the heat exchanger of FIG. 1, showing the characteristics of the thermal fluid flowing about the heat exchanging tube.
Figure 4:
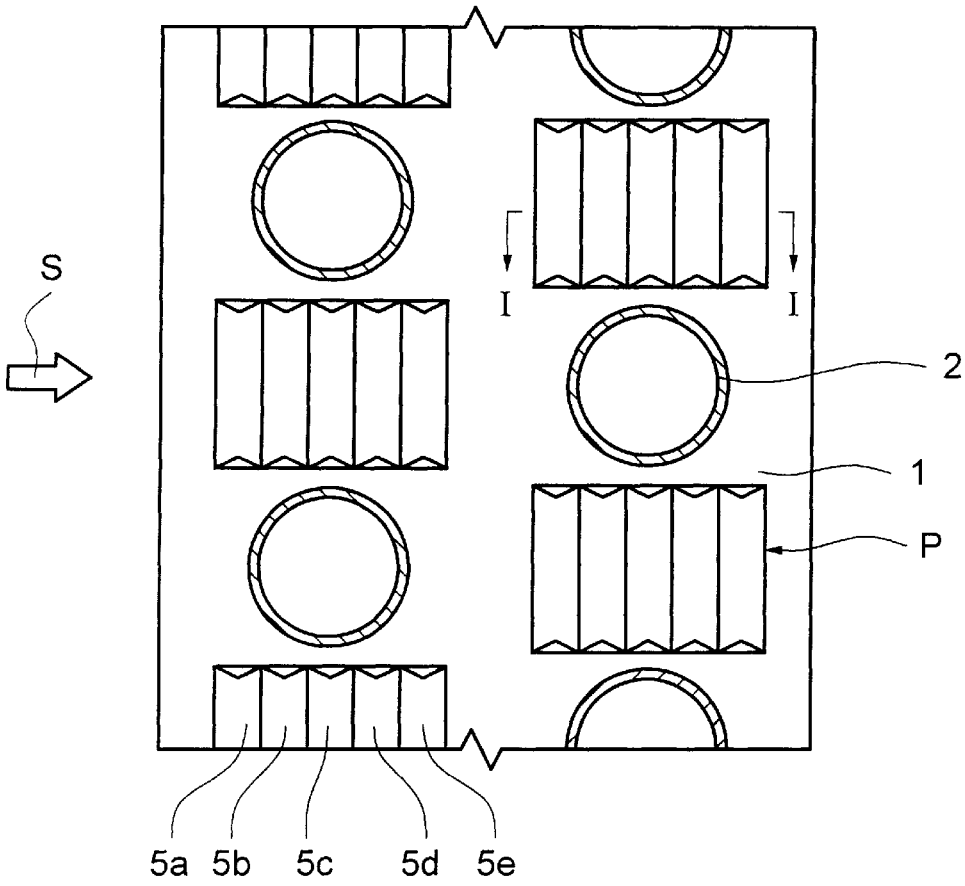
FIG. 4 (PRIOR ART)
FIG. 4 is a front view of a flat fin of another conventional heat exchanger.
Figure 5:
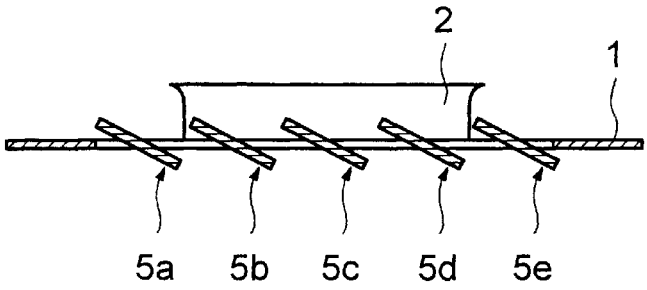
FIG. 5 (PRIOR ART)
FIG. 5 is a sectional view of the flat fin taken along the section line A—A in FIG. 4.
Figure 6:
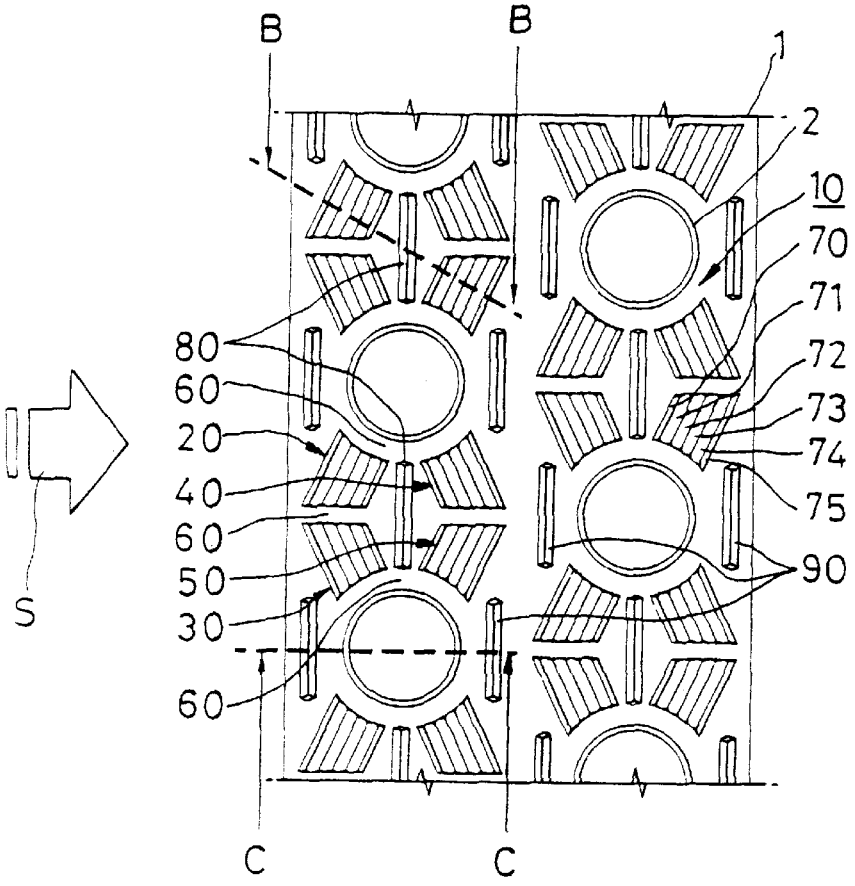
FIG. 6 is a front view of a flat fin in accordance with a heat exchanger of the present invention.

Referring to FIG. 6, reference numeral 10 generally denotes a group of four angled louver patterns radially located around each tube 2, respectively. The louvers cause the air currents to be turbulent and to be mixed up, which effectively reduces a dead air region behind each tube 2 in a direction of the air flow and thus improves the heat transfer performance. Improvement is accomplished by a group of the angled louver patterns located above and below the tube 2, wherein the louver patterns located below tube 2 comprise a first louver pattern 20 configured to guide an air current flow in a first direction and a third louver pattern 40 inclined opposite to the first louver pattern 20 such that said guided air current is guided in an opposing second direction. Louver patterns arranged below the tube 2 comprise a second angled louver pattern 30 and a fourth louver pattern 50 inclined opposite to the second louver pattern as in the case of the first and third patterns, and wherein those louver patterns 10–50 are radially positioned relative to respective tubes 2 to encompass the tubes 2.

Also, the angled first and second louver patterns 20 and 30 are placed in mirror image relationship to each other such that the air currents flowing over both surfaces of the flat fin 1 and in a front half of the area between the tubes 2 become turbulent flow and are mixed up. Further, the angled third and fourth louver patterns 40 and 50 are similarly placed in mirror image relationship to each other such that the currents having passed the patterns 20 and 30 continue to pass the remaining rear half of the area between the tubes 2 and become turbulently mixed up, thereby reducing the dead air region.

Figure 7:
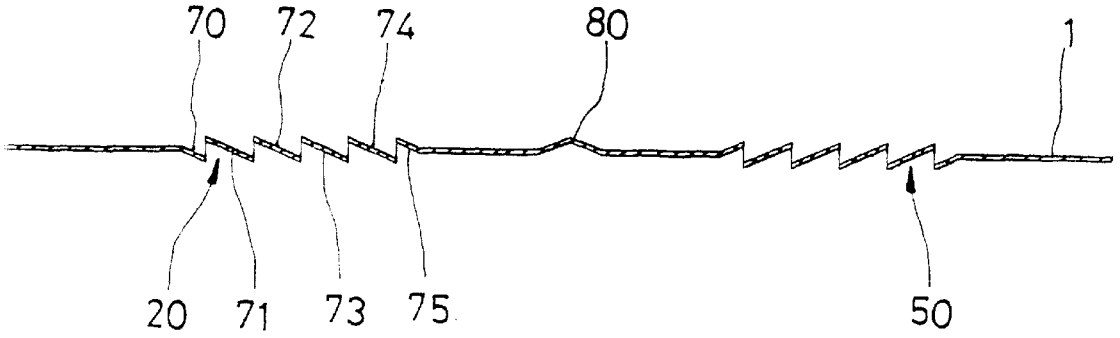
FIG. 7 is a sectional view of the flat fin taken along the section line B—B in FIG. 6.
Figure 8:
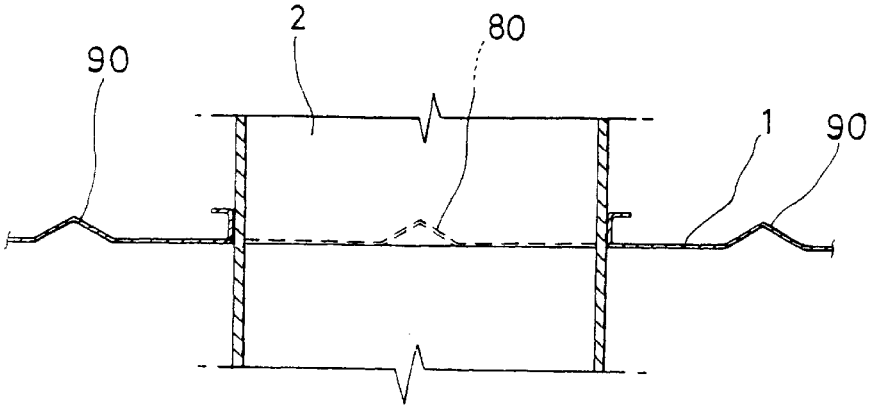
FIG. 8 is a sectional view of the flat fin taken along the section line C—C in FIG. 6.

Each of the first and second louver patterns 20, 30 has inclined strips or louvers (see FIG. 7), each of which has an upstream edge UE projecting past a first surface S' of the flat fin 1 and a downstream edge DE projecting past a second surface S" of the flat fin 1. Each strip or louver provides a slit formed to be perpendicular to the air flow. The strips of an inclined orientation according to the present invention may be formed by way of a cutting process. The third and fourth louver patterns 40, 50 are similar to those first and second louver patterns 20, 30, but the slits thereof are inclined in the opposite direction (see FIG. 7).

A roughly semi-circular base portion 60 occupies an area defined between upper ends of the first and third louver patterns 20, 40 and a lower outer circumference of a tube 2. With the base portion 60 interposed therebetween and further the tube 2 centered, the first and third louver patterns 20, 40 are radially oriented relative to the centered tube 2. Similarly, the second and fourth louver patterns 30, 50 are radially oriented relative to an upper outer circumference of a tube 2, with a certain round semi-circular base portion 60*a* interposed therebetween.

The first and third louver patterns 20, 40 and the second and fourth louver patterns 30, 50 are symmetrically formed relative to each other, these patterns being separated by a base portion 60*b* therebetween.

The louvers of each pattern are sequentially arranged without any base portion of the fin disposed therebetween and are directly formed by way of cutting process.

In the drawings, reference numerals 80 denote first beads which are positioned above or below a tube 2. Reference numerals 90 denote second beads positioned in front of or behind a tube 2. The beads, formed by way of a beading process, serve to drain condensed water that may be formed on the heat exchanging tubes 2, as well as to further reinforce the flat fin 1 and enlarge the surface area of the flat fin 1.

Namely, the first beads 80 are vertically separated by the round base portions 60 or 60*a* from a tube 2. The second beads 90 are horizontally separated from a tube 2 by base portions 60*a*.

Each bead is configured to project above the first surface S' of the flat fin 1, and is symmetrical relative to a central longitudinal axis thereof. Left and right halves of each bead are symmetrically bent at a suitable angle, respectively.

The first beads 80 respectively are positioned above and blow a tube 2 and are situated between the first and third louver patterns 20 and 40 and between the third and fourth louver patterns 30, 50. Each of the second beads 90 has a vertical length sized to be identical with the diameter of the tube 2.

An operation and effect of the heat exchanger for the air conditioner will be described.

Figure 9:
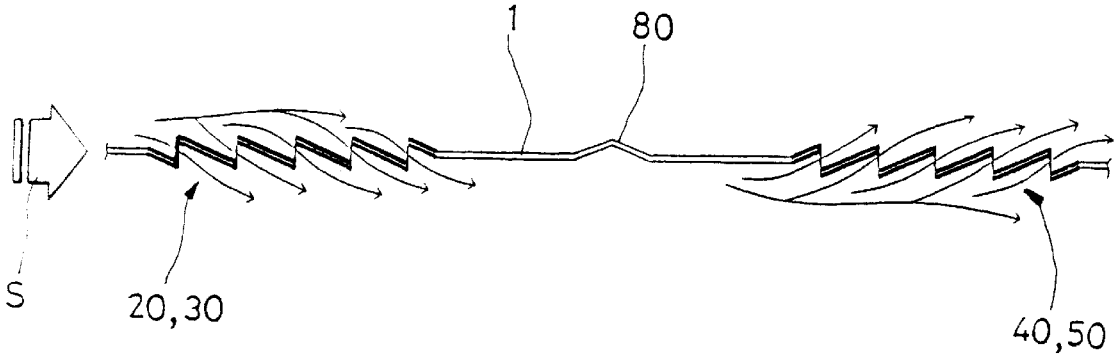
FIG. 9 is a schematic diagram explaining the air currents flow in the flat fin in accordance with the present invention.

When the air currents flow in the space defined between the fins 1 in the direction of the arrow S in FIG. 6, the air currents sequentially pass through the first and third louver patterns 20, 30 and then through the second and fourth patterns 40, 50 around tubes 2 in the directions of the arrows shown in FIG. 9. This operation allows the thermal flow from the heat exchanging tube 2 to be continuously transferred and to be turbulent and mixed up.

When the air currents flow in the spaces defined between adjacent fins 1 in the direction of the arrow S in FIG. 9, the air currents sequentially pass through the first and third louver groups 20 and 40, or the second and fifth louver groups 30, 50 while passing around the respective tubes 2. As the air current flowing along the first surface S' encounters the first louver group 20, some of the air is caused to flow through the fin via the slits defined by the louvers 70–75, whereby the air becomes transferred to the second surface S" of the fin. Simultaneously, that air becomes mixed with air that is already flowing along the second surface S" so as to become turbulent and mixed therewith. Thereafter, the air flowing along the second surface S" encounters the third louver group 40, and some of that air is caused to flow back through the fin via the slits formed by the louvers of the third louver group, and is thus transferred to the first surface S' where it becomes turbulent and mixed with air already flowing along the first surface S'.

The turbulent and mixed air currents continuously flow throughout a whole area around each tube 2, and are moved towards the rear of each tube 2, resulting in significantly less drop of the pressure and promotion of a smooth flow of the air currents.

The semi-circular base portions 60, 60*a* interposed between a tube 2 and the radially disposed first to fourth louver patterns 20 to 50 allow the turbulent air currents passing through said patterns 20 through 50 to be capable of further flowing into the dead air region. Thus, the dead air region becomes considerably reduced, and the heat transfer effect in the dead air region is further improved.

In addition, when the heat exchanger is used as an evaporator for a cooling apparatus or a condenser, so called condensed water is generated due to a temperature difference between a refrigerant flowing inside the heat exchanging tube 2 and the air currents flowing in the space between the flat fins 1 (e.g., a dew-forming phenomenon). In this regard, the beads 80, which enlarge the surface area of the flat fin 1, provide paths along which the condensed water can readily flow.

As described above, this invention prevents the pressure drop of the flowing air currents and provides turbulence and mixture of the air currents. Further, the invention improves the hear transfer effect and reduces the dead air region around the heat exchanging tubes. Therefore, the continuity of the heat transfer from the tube into other places can be guaranteed. Further, the improved heat transfer into a center portion between a plurality of heat exchanging tubes is also provided. Moreover, the beads provide the enlargement of the surface area of the flat fin, along with paths through which the generated condensed water flow.

What is claimed is:

1. A heat exchanger comprising a plurality of parallel fins for conducting air flows therebetween, and parallel tubes passing perpendicularly through the flat fins for conducting heat exchanging fluid; each flat fin including four vertical beads associated with each of the tubes for draining condensed water, the four beads comprising first and second beads situated above and below a respective tube, and third and fourth beads situated in front of and behind the respective tube; each of the first and second beads lying on a vertical line passing through a center axis of the respective tube; each of the third and fourth beads having a vertical length substantially equal to a diameter of the respective tube; each fin further including a group of louver patterns disposed between each vertically spaced pair of the tubes, each louver pattern comprising a plurality of parallel louvers; each louver forming a slit for directing air from one side of the fin to the other side thereof; each group of louver patterns comprising first, second, third and fourth louver patterns; the first and third louver patterns being spaced horizontally from one another on opposite sides of one of the first and second beads; the first and third louver patterns disposed below one of the tubes of each pair of tubes and oriented generally radially with respect thereto; the second and fourth louver patterns being spaced horizontally from each other beneath the first and third louver patterns, respectively, and being oriented generally radially with respect to the other of the tubes of each pair of tubes; each of the louvers being inclined relative to a plane of the fin whereby each louver has an upstream edge disposed to one side of the fin and a downstream edge disposed to the other side of the fin; the louvers of the first and second louver patterns being inclined in a direction opposite the inclination of the louvers of the third and fourth louver patterns.

* * * * *